US006835100B1

(12) United States Patent
Chen

(10) Patent No.: US 6,835,100 B1
(45) Date of Patent: Dec. 28, 2004

(54) MULTI-IN-ONE CONNECTOR STRUCTURE

(75) Inventor: Yuan-Hua Chen, Taoyuan Hsien (TW)

(73) Assignee: Kingconn Technology Co., Ltd., Taoyuan Hsien (TW)

( * ) Notice: Subject to any disclaimer, the term of this patent is extended or adjusted under 35 U.S.C. 154(b) by 0 days.

(21) Appl. No.: 10/815,864

(22) Filed: Apr. 2, 2004

(30) Foreign Application Priority Data

Dec. 2, 2003 (TW) ..... 92221198 U

(51) Int. Cl.[7] ..... H01R 24/00
(52) U.S. Cl. ..... 439/630; 439/924.1
(58) Field of Search ..... 439/629, 630, 439/60, 260, 924.1, 636

(56) References Cited

U.S. PATENT DOCUMENTS 6,287,151 B1 * 9/2001 Matsuzaki et al. ..... 439/630
6,695,647 B2 * 2/2004 Tsai ..... 439/630
6,716,066 B1 * 4/2004 Kuo ..... 439/630
6,776,631 B2 * 8/2004 Shimada et al. ..... 439/159

* cited by examiner

*Primary Examiner*—Truc T. Nguyen
*Assistant Examiner*—James R. Harvey
(74) *Attorney, Agent, or Firm*—Troxell Law Office PLLC

(57) ABSTRACT

A connector structure for multi-storage media comprises: a printed circuit board; a housing; a plurality of first terminals; a plurality of second terminals; a plurality of third terminals; and a plurality of fourth terminals; thereby, when inserting a plurality of memory cards such as xD card, SD/MMC card, Smart Media card or a MS card, respectively into the insertion slot from the front end of the housing, a plurality of contacts of the memory cards can contact with the first terminals, second terminals, third terminals or fourth terminals respectively for accessing the memory cards.

13 Claims, 8 Drawing Sheets

MULTI-IN-ONE CONNECTOR STRUCTURE

BACKGROUND OF THE INVENTION

1. Field of the Invention

The present invention relates to a memory card connector and, more particularly, to a connector structure for multi-in-one connector structure, which has a inserting slot in the open side of the housing for receiving any of a variety of memory cards such as xD card, MS card, SM card, SD card, or MMC card, and one end of the first terminals, second terminals, third terminals and fourth terminals are protruded out from the housing and intersected as a row so as to couple to the printed circuit board.

2. Description of the Related Art

Generally, the prior art card reader structure has multi-in-one functions, such as reading xD memory card, MS memory card, SM memory card, SD memory card, or MMC memory card etc., functions, so as to provide a convenience to the users.

Please refer to the FIGS. 1*a* and 1*b*, which show the top view and sectional view of the prior art multi-in-one connector structure. As shown in the Figs., the prior art multi-in-one connector structure at least comprises: a plurality of first terminals 71, a plurality of second terminals 72 and a plurality of third terminals 73. When the first terminals 71, second terminals 72 and third terminals 73 had soldered on the printed circuit board, if one of the first terminals 71 is found that it had soldered badly, there is not enough space to repair the badly soldered first terminals 71. If the engineer wants to repair the badly first terminals 71, he/she must de-solder the second terminals 72 apart from the printed circuit board first and then repair the badly soldered first terminals 71, thus will waste time and it is easy to destroy the second terminals 72.

SUMMARY OF THE INVENTION

The present invention has been accomplished under the circumstances in view. According to one aspect of the present invention, the multi-in-one connector structure has an insertion slot and four sets of terminals respectively suspended in the insertion slot at different locations for the connection of one of a set of memory cards including xD card, MS card, SM card, SD card, or MMC card and one end of the first terminals, second terminals, third terminals and fourth terminals are protruded out from the housing and intersected as a row so as to couple to the printed circuit board.

The multi-in-one connector structure of the present invention comprises: a housing, having an insertion slot for holding at least one memory card, and the top surface of the housing having a plurality of openings; a plurality of first terminals, having a curved shape, each first end of the first terminals inserted into the insertion slot and extended into the openings from the rear end of the housing, and each second end of the first terminals extended downwardly out of the rear end of the housing and extended horizontally for mounting; a plurality of second terminals, also having a curved shape, each first end of the second terminals inserted into the insertion slot and located under the first terminals from the rear end of the housing, and each second end of the second terminals extended downwardly out of the rear end of the housing and extended horizontally for mounting and intersected with the first terminals; a plurality of third terminals, also having a curved shape, each first end of the third terminals inserted into the insertion slot and located under the second terminals from the rear end of the housing, and each second end of the third terminals extended downwardly out of the rear end of the housing and extended horizontally for mounting, and the second end of the third terminals being shorter than the second end of the first and second terminals, wherein, the second ends of the first terminals are positioned alternately to the second ends of the second terminals; and a plurality of fourth terminals, each first end of the fourth terminals inserted into the insertion slot from the front end of the housing and closed to the third terminals, and each second end of the fourth terminals extended downwardly out of the rear end of the housing and extended horizontally for mounting; thereby, when inserting a plurality of memory cards respectively into the insertion slot from the front end of the housing, a plurality of contacts of the memory cards can contact with the first terminals, second terminals, third terminals or fourth terminals respectively for accessing the memory cards.

According to another aspect of the present invention, the terminals each have a respective soldered end protruded out from the bottom side of the housing for soldering to a printed circuit board through surface mounting technique.

DETAILED DESCRIPTION OF THE PREFERRED EMBODIMENT

Figure 1A:
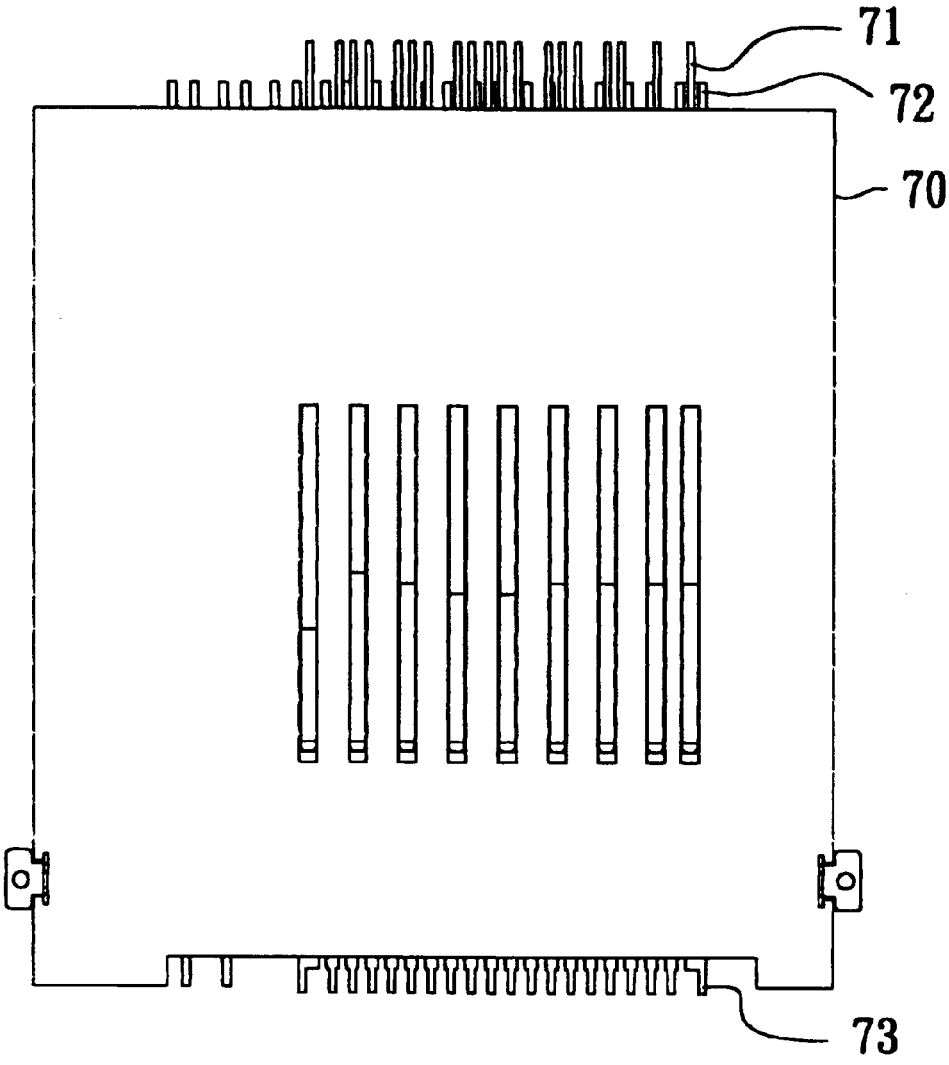
(PRIOR ART) FIG. 1a
FIGS. 1*a* and 1*b* respectively show the top view and sectional view of the prior art multi-in-one connector structure.
Figure 1B:
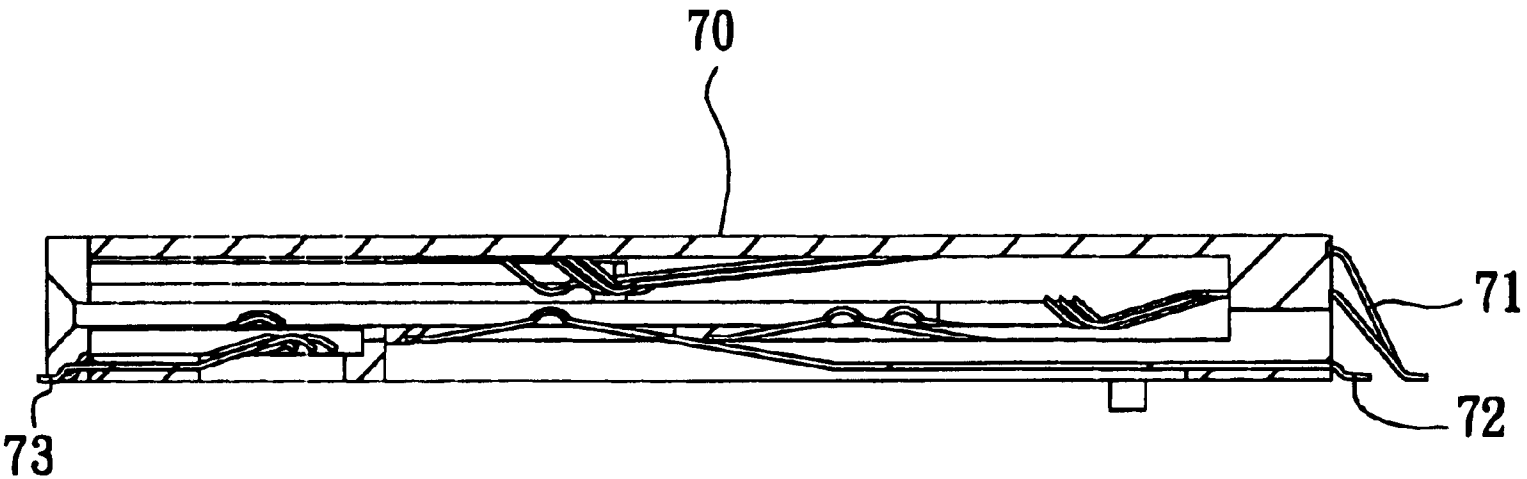
(PRIOR ART) FIG. 1b
Figure 2:
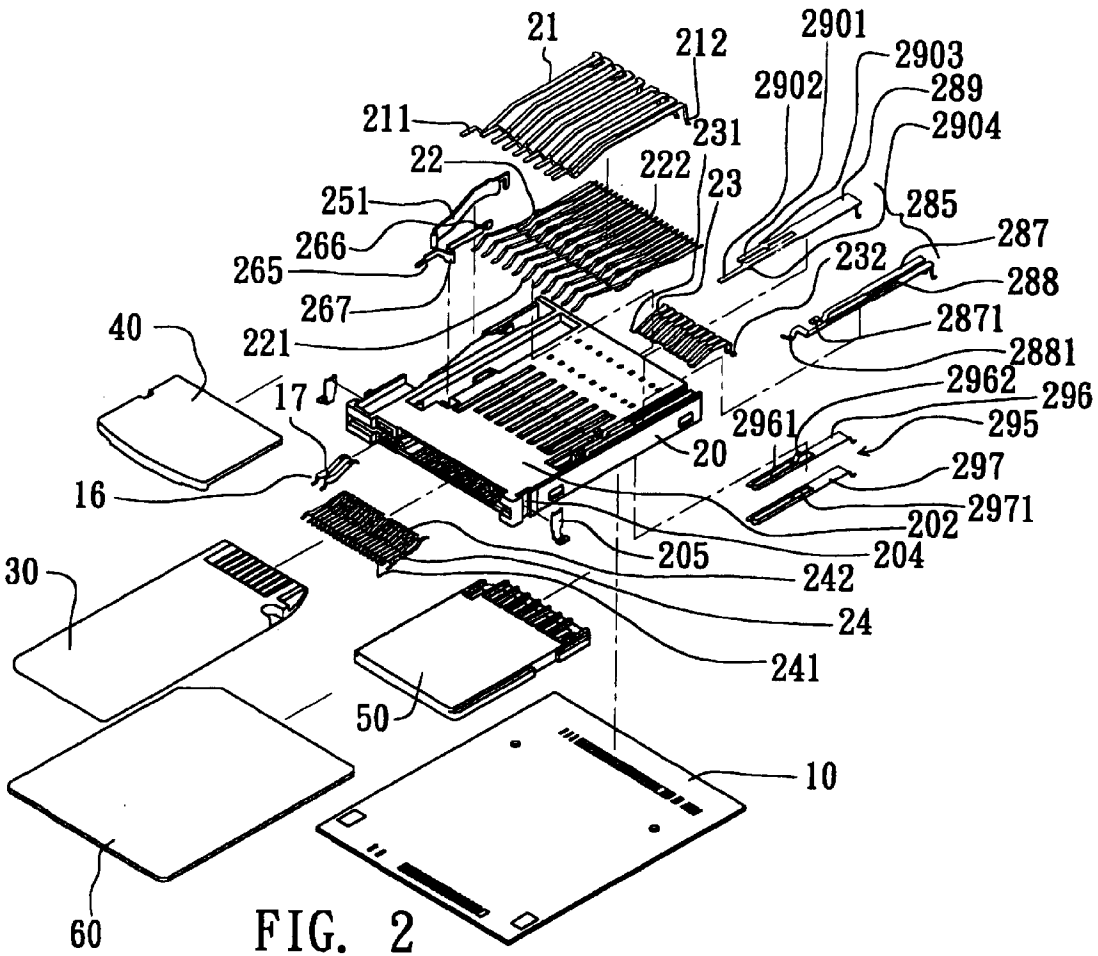
FIG. 2 shows the exploded view of the multi-in-one connector structure according to one embodiment of the present invention.
Figure 3:
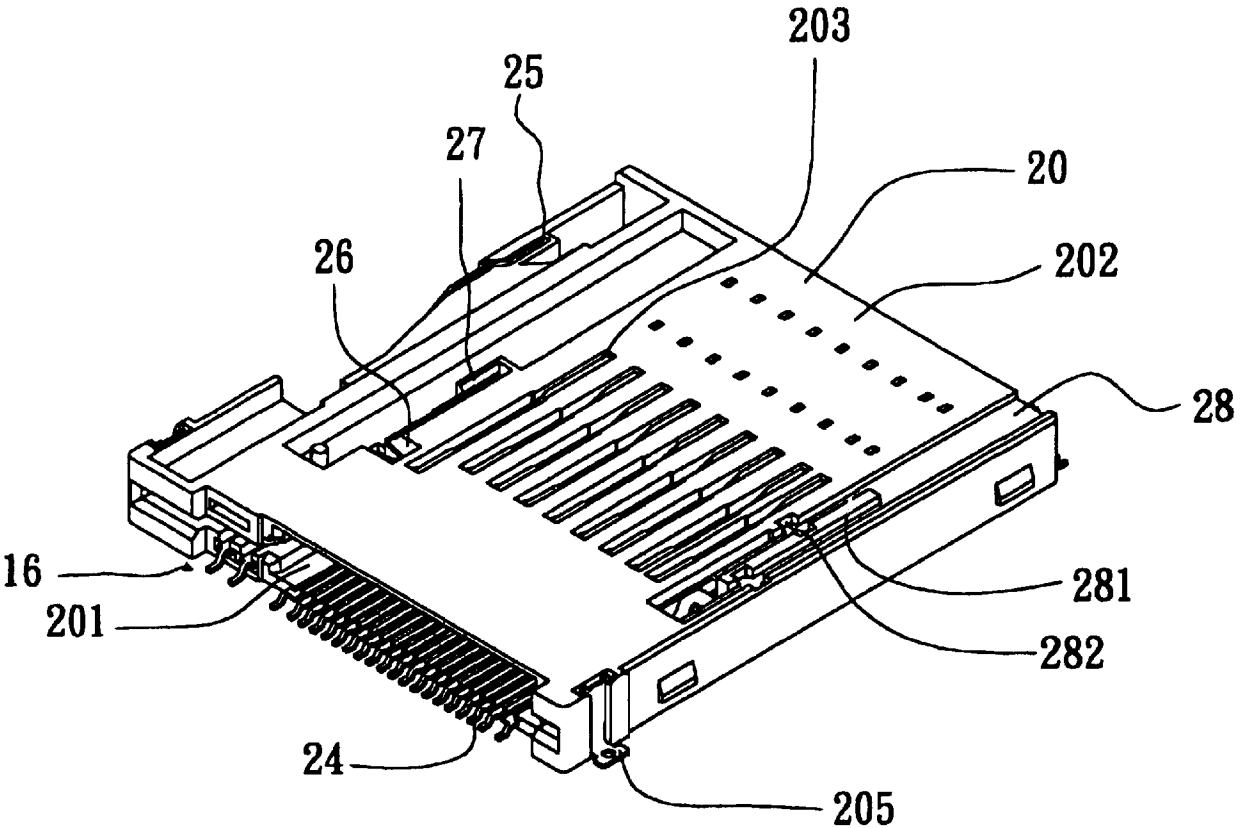
FIG. 3 shows the assembly view of the multi-in-one connector structure according to one embodiment of the present invention.

Referring to FIGS. 2–3, which show the exploded view and assembly view of the multi-in-one connector structure according to one embodiment of the present invention. As shown in the FIG. 2, the multi-in-one connector structure of the present invention comprises: a housing 20, a plurality of first terminals 21, a plurality of second terminals 22, a plurality of third terminals 23 and a plurality of fourth terminals 24.

Wherein, the housing 20 is made of electrically insulating material, having an insertion slot 201 for holding at least one memory card, and the top surface 202 of the housing 20 having a plurality of openings 203, and the both sides of the housing 20 further comprise a mounting hole 204, respectively, and the mounting hole 204 could be combined with a fastener 205 and soldered on a printed circuit board 10 by using Surface Mount Technology (SMT). The insertion slot 201 is made subject to the sizes and shapes of different memory cards such as xD card, MS card, SM card, SD card, or MMC card. The first terminals 21, have a curved shape, each first end 211 of the first terminals 21 inserted into the insertion slot 201 and extended into the openings 203 from the rear end of the housing 20, and each second end 212 of the first terminals 21 extended downwardly out of the rear end of the housing 20 and extended horizontally for mounting on the printed circuit board 10; wherein, the first terminals 21 are contacting with the contacts of the SD/MMC memory card 50 preferably.

The second terminals 22, also have a curved shape, each first end 221 of the second terminals 22 inserted into the insertion slot 201 and located below the first terminals 21 from the rear end of the housing 20, and each second end 222 of the second terminals 22 protruded out from the rear end of the housing 20 for mounting and intersected with the first terminals 21 so as to be mounted on the printed circuit board 10; wherein, some first end 221 of the second terminals 22 are longer than the others first end 223 of the second terminals 22, and the second terminals 22 are contacting with the contacts of the SM (Smart Media) memory card 60 preferably.

The third terminals 23, also have a curved shape, each first end 231 of the third terminals 23 inserted into the insertion slot 201 and located below the second terminals 22 from the rear end of the housing 20, and each second end 232 of the third terminals 23 protruded out from the rear end of the housing 20 and intersected with the first terminals 21 and the second terminals 22 so as to be mounted on the printed circuit board 10; wherein, the third terminals 23 are contacting with the contacts of the MS (Memory Stick) memory card 30 preferably.

The fourth terminals 24, each first end 241 of the fourth terminals 24 is inserted into the insertion slot 201 from the front side of the housing 20 and protruded out from the housing 20 and extended downwardly and then closed to the third terminals 23, and each second end 242 of the fourth terminals 24 extended downwardly out of the rear end of the housing 20 and extended horizontally so as to be mounted on the printed circuit board 10; wherein, the fourth terminals 24 are contacting with the contacts of the xD memory card 40 preferably.

Furthermore, the present invention further comprises a first cavity 25 and a first anti-missing-inserting device 251 to prevent missing insertion, wherein, the first cavity 25 is positioned left-above the housing 20 and the first anti-missing-inserting device 251 is positioned inside the first cavity 25 for preventing the Smart Media memory card 60 from being inserted.

Furthermore, the housing 20 further comprises a second cavity 26, a third cavity 27 and a blocker 265, wherein, the second cavity 26 and the third cavity 27 are positioned left-above the housing 20 and the blocker 265 further comprises a handle portion 266 and a ladle portion 267, while assembling, the handle portion 266 can be positioned inside the third cavity 27, and then the ladle portion 267 can be positioned inside the second cavity 26 for fastening the SD memory card 50.

Furthermore, the housing 20 further comprises a fourth cavity 28 and a first card detecting device 285; wherein, the fourth cavity 28 is positioned right-above the housing 20 and further comprises a partition portion 281 and the partition portion 281 having a plurality of fifth cavities 282 and the first card detecting device 285 further comprises a first detecting apparatus 286 and a second detecting apparatus 289; wherein, the first detecting apparatus 286 further comprises a sixth terminal 287 and a seventh terminal 288; wherein, one end 2871 of the sixth terminal 287 is extended downwardly and extended upwardly and then extended horizontally, and one end 2881 of the seventh terminal 288 is extended left and extended downwardly and then extended upwardly; the second detecting apparatus 289 further comprises a eighth terminal 290, wherein, the eighth terminal 290 has two forked end portions 2901,2902 with different length and the protrusion portions 2903,2904 are respectively positioned at or about the central portion of each end portion 2901,2902, and the sixth terminal 287, the seventh terminal 288 and another end of the eighth terminal 290 are protruded out from the housing 20 and extended downwardly and then extended upwardly for coupling to the printed circuit board 10; while assembling, the sixth terminal 287 and the seventh terminal 288 could be positioned respectively at both sides of the partition portion 281, and the eighth terminal 281 could be positioned left-above the seventh terminal 288 and the protrusion portion 2903 engaged with the concave portion 282 of the partition portion 281 to prevent the eighth terminal 290 contact with the sixth terminal 287 and the seventh terminal 288; thereby, while the SD memory card or the MMC memory card being inserted into the slot 201, the connector could detect the inserting of the SD memory card or the MMC memory card 50.

Furthermore, the housing 20 further comprises a card detecting and writing device 295 positioned below the third terminals 23, and further comprises a detecting part 296 and a write-protecting part 297; wherein, portion of the detecting part 296 is hollow and has a first metal sheet 2961 positioned inside the hollow portion and one end of the first metal sheet 2961 has a protrusion portion 2962, and the write-protecting part 297 also has a hollow portion and has a second metal sheet 2971 positioned inside the hollow portion; another end of the detecting part and write-protecting part 295 are respectively protruded out from the housing 20 and extended downwardly and then extended horizontally so as to couple to the printed circuit board 10; thereby, while the SD memory card or the MMC memory card 50 being inserted into the slot 201, the connector could detect the inserting of the SD memory card or the MMC memory card 50, and if the write-protecting switch (not shown) of the SD memory card or the MMC memory card 50 is opened, the write-protecting part 297 will contact with the detecting part 296, so as to allow writing data to the SD memory card or the MMC memory card 50.

Referring to FIG. 3 shows an assembly view of the multi-in-one connector structure according to one embodiment of the present invention. As shown in: FIG. 3, the multi-in-one connector structure of the present invention is shown comprised of a housing 20, a plurality of first terminals 21, a plurality of second terminals 22, a plurality of third terminals 23 and a plurality of fourth terminals 24. Wherein, the first terminals 21 are located at the top most position of the housing 20; the second terminals 22 are located below the first terminals 21 and each second end 222 of the second terminals 22 protruded out from the rear end of the housing 20 and intersected with the first terminals 21 as a row; the third terminals 23 are located below the second terminals 22, and the second end 232 of the third terminal 233 are intersected with the first terminals 21 and the second terminals 22 as a row so as to be mounted on the printed circuit board 10; the fourth terminals 24, each first end 241 of the fourth terminals 24 is inserted into the insertion slot 201 from the front side of the housing 20 and closed to the third terminals 23, and another ends 242 of the fourth terminals 24 are protruded out from the front side of the housing 20 for mounting. Besides, the connector structure of the present invention further comprises a write protection device 16 installed in the housing 20 at one side of the fourth terminals 24 for preventing from data being written into the Smart Media memory card 60, wherein the write protection device 16 further comprises a plurality of fifth terminals 17.

Figure 4A:
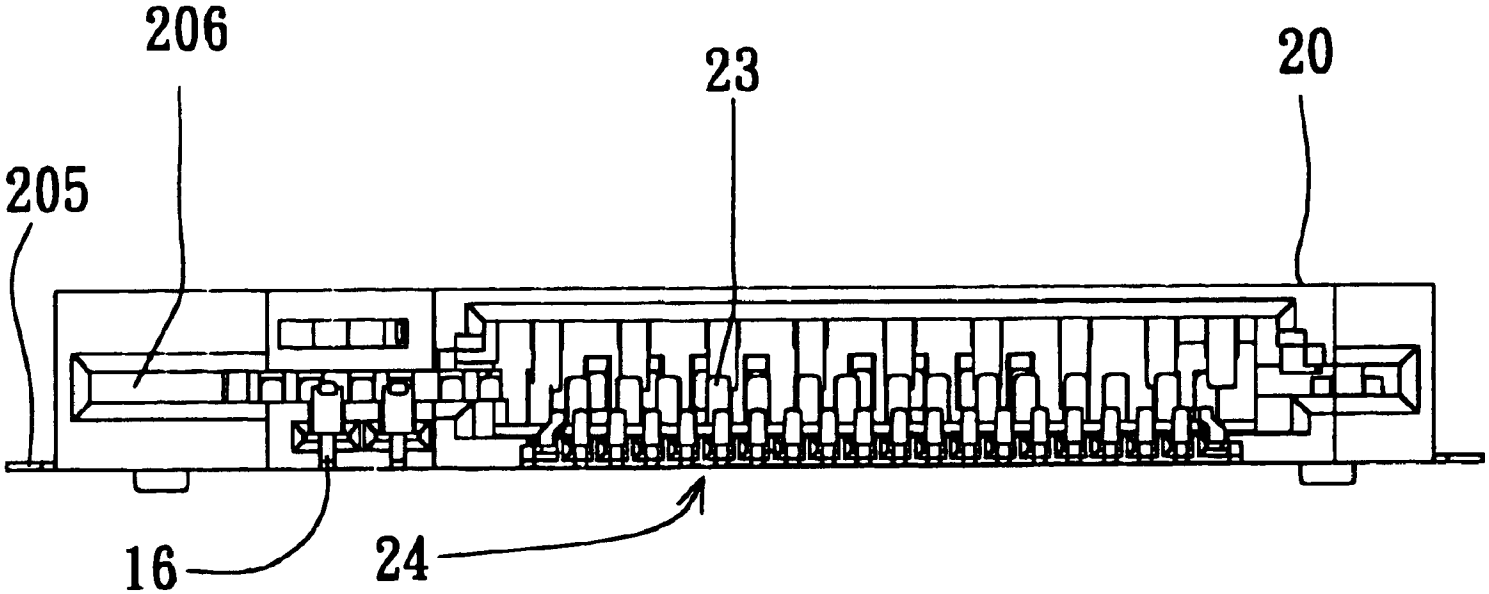
FIG. 4*a* shows a front view of the multi-in-one connector structure according to one embodiment of the present invention.

Referring to FIG. 4*a* shows a front view of the multi-in-one connector structure according to one embodiment of the present invention. As shown in FIG. 4*a*, the first terminals 21 are located at the top most position of the insertion slot 201 of the housing 20, obviously; the second terminals 22 are located below the first terminals 21 and intersected with the third terminals 23; and the fourth terminals 24 are located at the most bottom position of the insertion slot 201 of the housing 20. The spaces 206 located at both sides of the insertion slot 201 provide a wider space for inserting the larger Smart Media memory card 60.

Figure 4B:
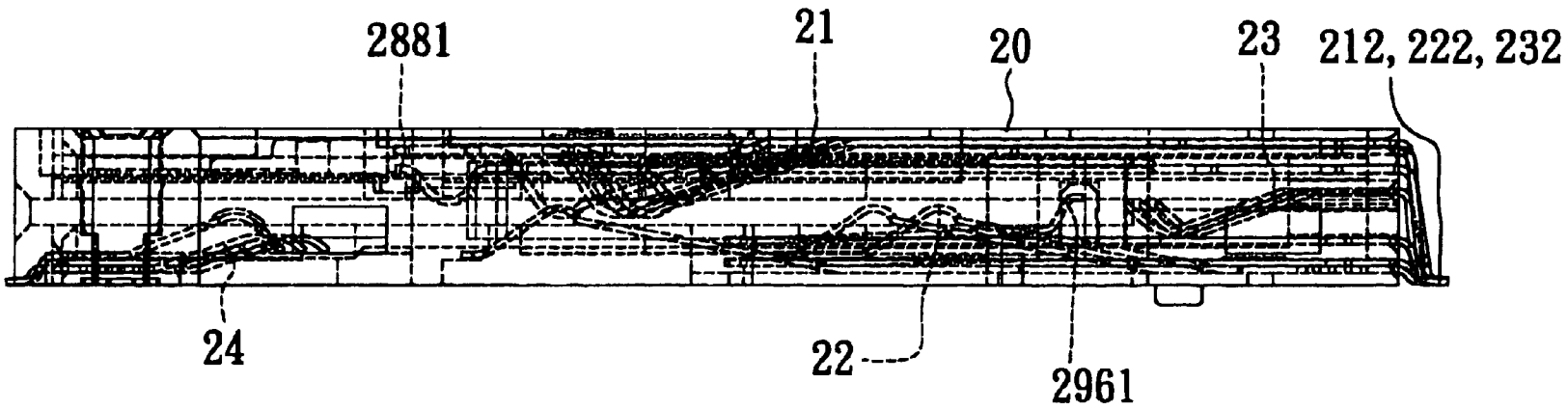
FIG. 4*b* shows a sectional view of the multi-in-one connector structure according to one embodiment of the present invention.

Referring to FIG. 4*b* shows a sectional view of the multi-in-one connector structure according to one embodiment of the present invention. As shown in FIG. 4*b*, we can see the locations of the first terminals 21, the second terminals 22, the third terminals 23 and the fourth terminals 24 clearly. Wherein, the first ends 241 of the fourth terminals 24 are inserted into the insertion slot 201 from the front side of the housing 20 and extended upwardly and extended downwardly and closed to the third terminals 23, and another ends 212 of the first terminals 21, another ends 222 of the second terminals 22 and another ends 232 of the third terminals 23 are intersected as a row for mounting on the printed circuit board 10. Furthermore, the relative locations of the protrusion portions 2903,2904 for detecting and write-protecting the SD memory card 50 and the blocker 265 for blocking and fastening the SD memory card 50 can be seen clearly.

Figure 4C:
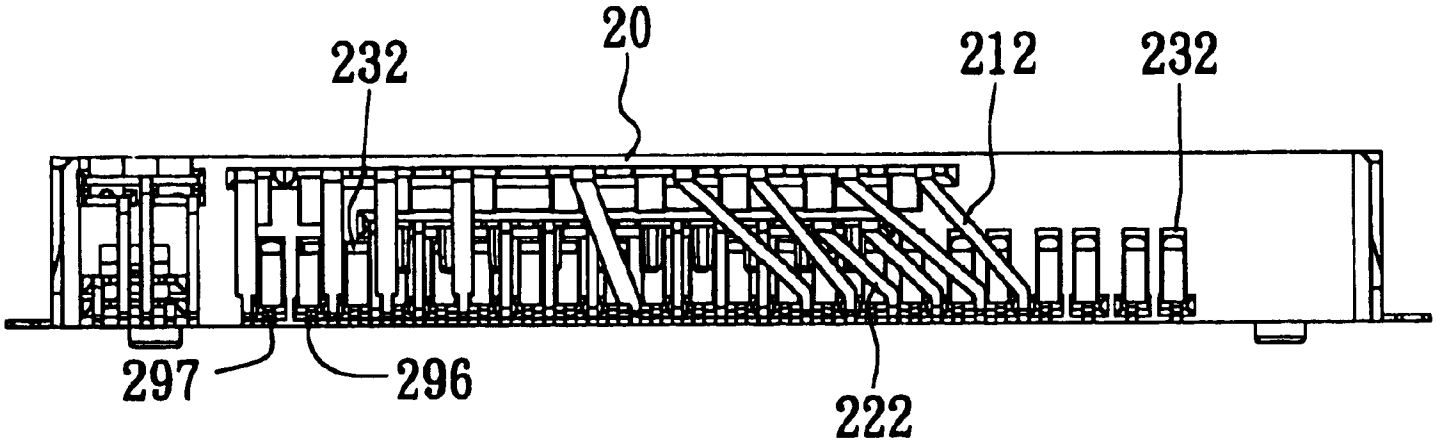
FIG. 4*c* shows a rear view of the multi-in-one connector structure according to one embodiment of the present invention.

Referring to FIG. 4*c* shows a rear view of the multi-in-one connector structure according to one embodiment of the present invention. As shown in FIG. 4*c*, we can see the second ends 212 of the first terminals 21, the second ends 222 of the second terminals 22, the second ends 232 of the third terminals 23, the first metal sheet 2961 and the second metal sheet 2971 are respectively extended downwardly out of the rear end of the housing 20 and extended horizontally and intersected as a row for mounting clearly, so as to easy assemble and repair.

Figure 4D:
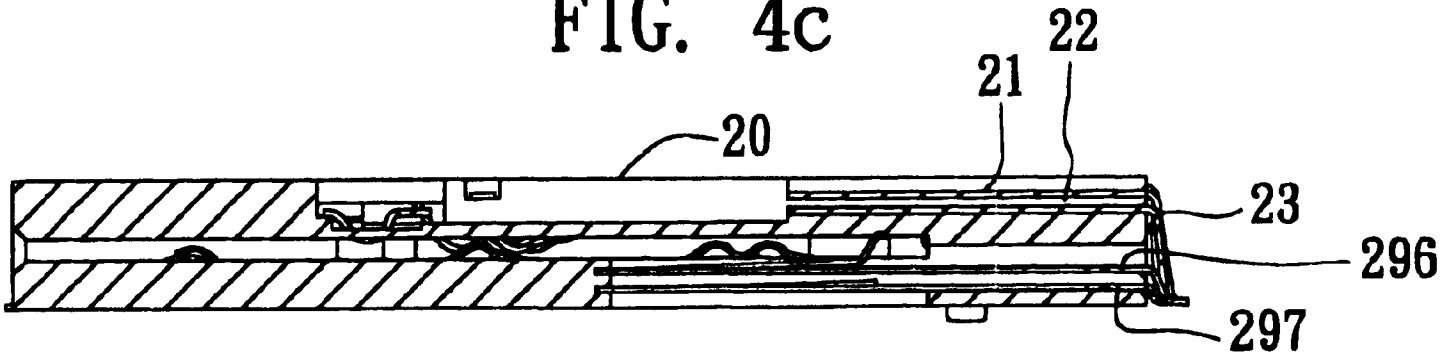
FIG. 4*d* shows a sectional view of the multi-in-one connector structure according to one embodiment of the present invention.

Referring to FIG. 4*d* shows a sectional view of the multi-in-one connector structure according to one embodiment of the present invention. As shown in FIG. 4*d*, we can see the first terminals 21, the second terminals 22, the third terminals 23, the first metal sheet 2961 and the second metal sheet 2971 are respectively positioned inside the inserting slot 201 of the housing 20 from top to bottom clearly, and the second ends of the first terminals 21, the second terminals 22, the third terminals 23, the first metal sheet 2961 and the second metal sheet 2971 are extended downwardly out of the rear end of the housing 20 and horizontally and intersected as a row for mounting, so as to easy assemble and repair.

Figure 4E:
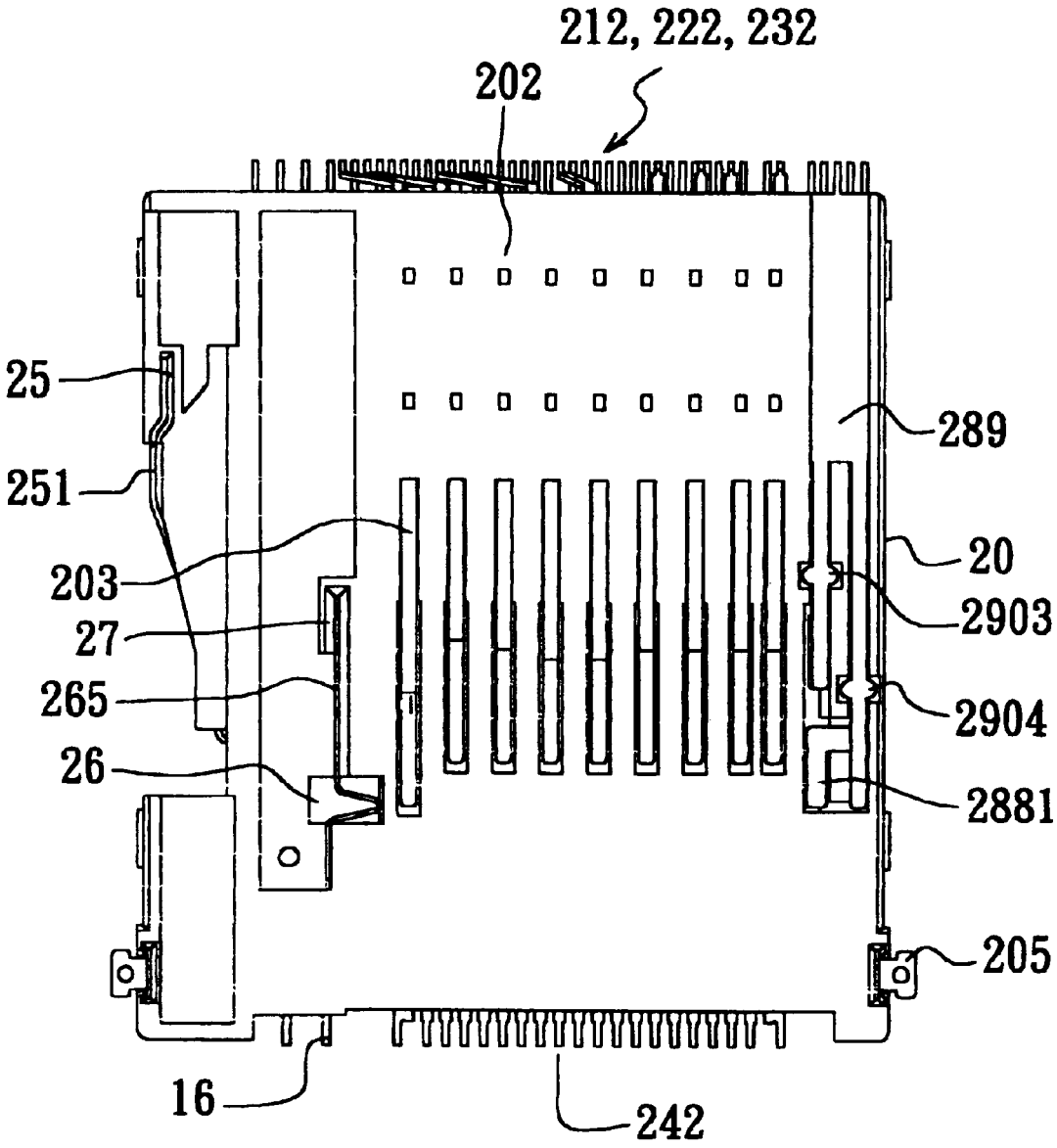
FIG. 4*e* shows a top view of the multi-in-one connector structure according to one embodiment of the present invention.

Referring to FIG. 4*e* shows a top view of the multi-in-one connector structure according to one embodiment of the present invention. As shown in FIG. 4*e*, we can see one end of the first terminals 21 mounted on the printed circuit board 10, and another ends of the second terminals 22, the third terminals 23 and the fourth terminals 24 are extended downwardly out of the rear end of the housing 20 and extended horizontally and intersected as a row for mounting on the printed circuit board 10, the second ends 222 of the second terminals 22, and the first metal sheet 2961 and the second metal sheet 2971 are respectively positioned inside the second cavity 26 and the third cavity 27. As such placement, if the user finds that one of the first terminals 21, the second terminals 22, the third terminals 23 or the fourth terminals 24 had been soldered badly, he/she only needs to de-solder the badly soldered terminal apart from the printed circuit board 10 first and then solder the terminal again, thus saving a lot of time.

As indicated above, the housing 20 needs only one insertion slot 201 to receive one of a set of different memory cards such as xD card, SM card, MS card, SD card, and MMC card. The arrangement of the write protection device 16 detects the insertion of a SD card and its write protection status.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A multi-in-one connector structure used in a card reader comprising:

a housing, having an insertion slot for holding at least one memory card, and the top surface of the housing having a plurality of openings;

a plurality of first terminals, having a curved shape, each first end of the first terminals inserted into the insertion slot and extended into the openings from the rear end of the housing, and each second end of the first terminals extended downwardly out of the rear end of the housing and extended horizontally for mounting;

a plurality of second terminals, also having a curved shape, each first end of the second terminals inserted into the insertion slot and located under the first terminals from the rear end of the housing, and each second end of the second terminals extended downwardly out of the rear end of the housing and extended horizontally and intersected with the first terminals for mounting;

a plurality of third terminals, also having a curved shape, each first end of the third terminals inserted into the insertion slot and located under the second terminals from the rear end of the housing, and each second end of the third terminals extended downwardly out of the rear end of the housing and extended horizontally for mounting, and the second ends of the third terminals being shorter than the second ends of the first and second terminals, wherein, the second ends of the first terminals are positioned alternately to the second ends of the second terminals; and a plurality of fourth terminals, each first end of the fourth terminals inserted into the insertion slot from the front end of the housing and closed to the third terminals, and each second end of the fourth terminals extended downwardly out of the rear end of the housing and extended horizontally for mounting;

thereby, when inserting a plurality of memory cards respectively into said insertion slot from said front end of said housing, a plurality of contacts of said memory cards can contact with said first terminals, second terminals, third terminals or fourth terminals respectively for accessing said memory cards.

2. The multi-in-one connector structure as claimed in claim 1, wherein said memory card can be a xD card, a SD/MMC card, a Smart Media card or a MS card.

3. The multi-in-one connector structure as claimed in claim 1, wherein said first terminals are contacting with said contacts of said SD/MMC memory card.

4. The multi-in-one connector structure as claimed in claim 1, wherein said second terminals are contacting with said contacts of said Smart Media memory card.

5. The multi-in-one connector structure as claimed in claim 1, wherein said third terminals are contacting with said contacts of said MS memory card.

6. The multi-in-one connector structure as claimed in claim 1, wherein said fourth terminals are contacting with said contacts of said xD memory card.

7. The multi-in-one connector structure as claimed in claim 1, wherein it further comprises at least one fastener and a mounting hole, wherein, said fastener is positioned inside said mounting hole and can be mounted on a printed circuit board for fastening said housing.

8. The multi-in-one connector structure as claimed in claim 1, wherein it further comprises a write protection device installed in said housing at one end of said fourth terminals for preventing from data being written into said Smart Media memory card.

9. The multi-in-one connector structure as claimed in claim 8, wherein said write protection device further comprises a plurality of fifth terminals.

10. The multi-in-one connector structure as claimed in claim 1, wherein said housing further comprises a first cavity and a first anti-missing-inserting device, wherein, said first cavity is positioned left-above said housing and said first anti-missing-inserting device is positioned inside said first cavity for preventing said Smart Media memory card from being inserted incorrectly.

11. The multi-in-one connector structure as claimed in claim 1, wherein said housing further comprises a second cavity, a third cavity and a blocker; wherein, said second cavity and said third cavity are positioned left-above said housing and said blocker further comprises a handle portion and a ladle portion, while assembling, said handle portion can be positioned inside said third cavity, and then said ladle portion can be positioned inside said second cavity for fastening said SD memory card.

12. The multi-in-one connector structure as claimed in claim 1, wherein said housing further comprises a fourth cavity and a first card detecting device; wherein, said fourth cavity is positioned right-above said housing and further comprises a partition portion and said partition portion having a plurality of fifth cavities and said first card detecting device further comprises a first detecting apparatus and a second detecting apparatus; wherein, said first detecting apparatus comprises a sixth terminal and a seventh terminal; wherein, said sixth terminal is extended downwardly and extended upwardly and then extended horizontally, and said seventh terminal is extended left and extended downwardly and then extended upwardly; said second detecting apparatus further comprises a eighth terminal, wherein, said eighth terminal has two forked end portions with different length and a protrusion portion is respectively positioned at said about central portion of each end portions, and said sixth terminal, said seventh terminal and another end of said eighth terminal are protruded out from said housing and extended downwardly and then extended upwardly for coupling to said second contacts; during assembling, said sixth terminal and said seventh terminal could be positioned respectively at both sides of said partition portion, and said eighth terminal could be positioned left-above said seventh terminal and said protrusion portion engaged inside said concave portion of said partition portion to prevent said eighth terminal contact with said sixth terminal and said seventh terminal; thereby, while said SD memory card or said MMC memory card inserted into said slot, said connector could detect said inserting of said SD memory card or said MMC memory card.

13. The multi-in-one connector structure as claimed in claim 1, wherein it further comprises a card detecting and writing device positioned below said third terminals, and further comprises a detecting part and a write-protecting part; wherein, said detecting part is a hollow portion and has a first metal sheet positioned inside said hollow portion and one end of said first metal sheet has a protrusion portion, and said write-protecting part is also a hollow portion and: has a second metal sheet positioned inside said hollow portion; another end of said detecting part and write-protecting part are protruded out from said housing and extended downwardly and then extended horizontally so as to couple to said second contacts; thereby, while said SD memory card or said MMC memory card inserted into said slot, said connector could detect said inserting of said SD memory card or said MMC memory card, and if said write-protecting switch of said SD memory card or said MMC memory card is opened, said write-protecting part will contact with said detecting part, so as to allow writing data to said SD memory card or said MMC memory card.

* * * * *